US010770216B2

(12) United States Patent
Tsukada et al.

(10) Patent No.: US 10,770,216 B2
(45) Date of Patent: Sep. 8, 2020

(54) REACTOR

(71) Applicant: FANUC CORPORATION, Yamanashi (JP)

(72) Inventors: Kenichi Tsukada, Yamanashi (JP); Masatomo Shirouzu, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 0 days.

(21) Appl. No.: 15/915,511

(22) Filed: Mar. 8, 2018

(65) Prior Publication Data

US 2018/0261371 A1 Sep. 13, 2018

(30) Foreign Application Priority Data

Mar. 13, 2017 (JP) ..... 2017-047521

(51) Int. Cl.

| | |
|---|---|
| ***H01F 27/02*** | (2006.01) |
| ***H01F 27/06*** | (2006.01) |
| ***H01F 27/24*** | (2006.01) |
| ***H01F 27/28*** | (2006.01) |
| ***H01F 27/08*** | (2006.01) |
| ***H01F 37/00*** | (2006.01) |
| ***H01F 3/14*** | (2006.01) |

(52) U.S. Cl.

CPC ..... *H01F 27/025* (2013.01); *H01F 3/14* (2013.01); *H01F 27/06* (2013.01); *H01F 27/085* (2013.01); *H01F 27/24* (2013.01); *H01F 27/28* (2013.01); *H01F 37/00* (2013.01)

(58) Field of Classification Search

CPC ..... H01F 27/025; H01F 27/06

See application file for complete search history.

(56) References Cited

U.S. PATENT DOCUMENTS

| | | | | |
|---|---|---|---|---|
| 1,526,347 | A * | 2/1925 | Knotts | H01F 27/025 |
| 2,229,680 | A * | 1/1941 | Somes | H05B 6/02 219/644 |
| 2,406,704 | A * | 8/1946 | Mossay | H01F 30/12 307/156 |
| 2,968,087 | A * | 1/1961 | Thompson | H01F 27/25 29/605 |
| 3,187,208 | A * | 6/1965 | Van De Graff | H02K 99/10 310/168 |
| 3,427,527 | A * | 2/1969 | Christensen | H01F 27/40 219/130.1 |
| 9,899,135 | B2 | 2/2018 | Nakanoue et al. | |

(Continued)

FOREIGN PATENT DOCUMENTS

| | | |
|---|---|---|
| DE | 1093897 B | 12/1960 |
| JP | 2009049082 A | 3/2009 |

(Continued)

*Primary Examiner* — Elvin G Enad
*Assistant Examiner* — Malcolm Barnes
(74) *Attorney, Agent, or Firm* — RatnerPrestia

(57) ABSTRACT

A reactor includes an outer peripheral iron core, and at least three core coils contacting or connected to an inner surface of the outer peripheral iron core. Each of the core coils includes a core and a coil wound onto the core. The reactor includes an attachment unit disposed on one end surface of the outer peripheral iron core, to attach the outer peripheral iron core in a predetermined position. At least one ventilation port is formed in an extension portion of the attachment unit.

6 Claims, 16 Drawing Sheets

(56) References Cited

U.S. PATENT DOCUMENTS

| | | | | |
|---|---|---|---|---|
| 2009/0261939 | A1* | 10/2009 | Shudarek | H01F 3/10 336/212 |
| 2010/0039201 | A1* | 2/2010 | Smalen et al. | H01F 27/025 |
| 2012/0326822 | A1* | 12/2012 | Yokota | H01F 27/306 336/67 |
| 2013/0106546 | A1* | 5/2013 | Outten | H01F 27/02 336/5 |
| 2013/0300528 | A1* | 11/2013 | Nobusaka et al. | H01F 27/025 |
| 2014/0204973 | A1* | 7/2014 | Kinoshita | G01K 13/00 374/152 |
| 2014/0361643 | A1* | 12/2014 | Kamiya | H02K 5/08 310/43 |
| 2015/0102882 | A1* | 4/2015 | Shudarek | H01F 37/00 336/10 |
| 2015/0162123 | A1* | 6/2015 | Ismodes Cascon | H01F 27/245 336/12 |
| 2015/0170821 | A1* | 6/2015 | Cornelius | H01F 27/2847 336/178 |
| 2015/0179330 | A1* | 6/2015 | Nakanoue | H01F 37/00 336/5 |
| 2016/0261174 | A1* | 9/2016 | Senoo | H02K 9/22 |
| 2017/0365391 | A1* | 12/2017 | Shudarek | H01F 27/245 |

FOREIGN PATENT DOCUMENTS

| | | | | |
|---|---|---|---|---|
| JP | 2010252539 | A | | 11/2010 |
| JP | 2012009529 | A | | 1/2012 |
| JP | 2015142095 | A | * | 8/2015 |
| WO | 2014073238 | A1 | | 5/2014 |

* cited by examiner

REACTOR

CROSS-REFERENCE TO RELATED APPLICATION

This application is a new U.S. Patent Application that claims benefit of Japanese Patent Application No. 2017-047521, filed Mar. 13, 2017, the disclosure of this application being incorporated herein by reference in its entirety for all purposes.

BACKGROUND OF THE INVENTION

1. Field of the Invention

The present invention relates to a reactor.

2. Description of Related Art

A technology in which a reactor is contained in a reactor case, and coolant circulates through storage space in the reactor case is conventionally known (refer to, for example, Japanese Unexamined Patent Publication (Kokai) No. 2009-49082).

SUMMARY OF THE INVENTION

However, since Japanese Unexamined Patent Publication (Kokai) No. 2009-49082 uses the reactor case, the structure increases in size and manufacturing cost.

Therefore, it is desired to provide a reactor having improved heat dissipation and reduced manufacturing cost, without an increase in size.

An embodiment of this disclosure provides a reactor that includes an outer peripheral iron core, and at least three core coils contacting or connected to an inner surface of the outer peripheral iron core. Each of the core coils includes a core and a coil wound onto the core. The reactor further includes an attachment unit disposed on one end surface of the outer peripheral iron core to attach the outer peripheral iron core in a predetermined position, and at least one ventilation port formed in the attachment unit.

According to the embodiment, the attachment unit is attached to only the one end surface of the outer peripheral iron core, and the at least one ventilation port is formed in the attachment unit. Thus, since a fluid, e.g., air flowing through the internal space of the outer peripheral iron core and the ventilation port of the attachment unit serves to dissipate heat, the reactor has improved heat dissipation. Furthermore, it is possible to eliminate the need to provide an additional member for heat dissipation in an installed state, thus preventing an increase in the size of the reactor, while allowing reductions in the manufacturing cost and weight of the reactor.

The above objects, features and advantages and other objects, features and advantages of the present invention will become more apparent from the following detailed description of preferred embodiments along with the accompanying drawings.

DETAILED DESCRIPTION OF THE INVENTION

Figure 1:
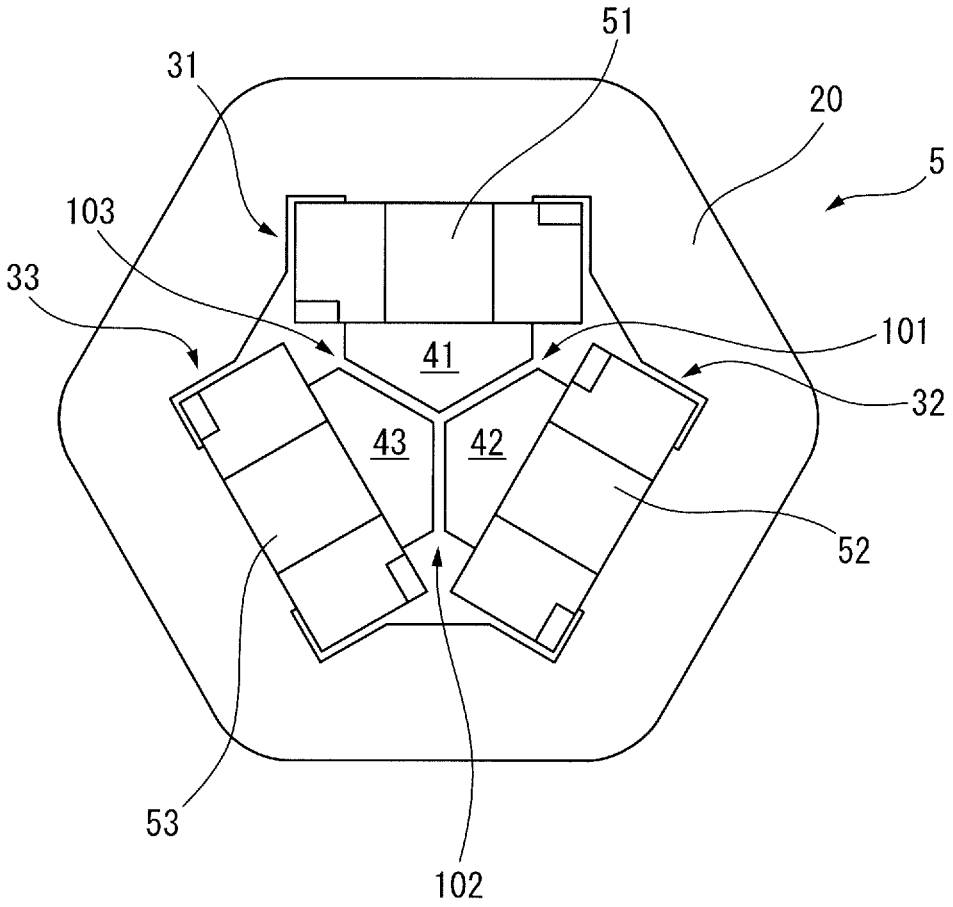
FIG. 1 is a top view of a reactor according to a first embodiment.

Embodiments of the present invention will be described below with reference to the accompanying drawings. In the drawings, the same reference numerals indicate the same components. For ease of understanding, the drawings are modified in scale in an appropriate manner.

FIG. 1 is a top view of a reactor according to a first embodiment. As shown in FIG. 1, a reactor 5 includes an outer peripheral iron core 20 having a hexagonal cross-section and at least three core coils 31 to 33 contacting or connected to an inner surface of the outer peripheral iron core 20. The number of cores is preferably an integral multiple of 3, and the reactor 5 can be thereby used as a three-phase reactor. Note that, the outer peripheral iron core 20 may be another polygonal shape or circular.

The core coils 31 to 33 include cores 41 to 43 and coils 51 to 53 wound onto the cores 41 to 43, respectively. Each of the outer peripheral iron core 20 and the cores 41 to 43 is made by stacking iron sheets, carbon steel sheets or electromagnetic steel sheets, or made of a pressed powder core.

As shown in FIG. 1, the cores 41 to 43 have approximately the same dimensions as each other, and are arranged at approximately equal intervals in the circumferential direction of the outer peripheral iron core 20. In FIG. 1, the cores 41 to 43 are in contact or integral with the outer peripheral iron core 20 at their radial outer end portions.

Furthermore, the cores 41 to 43 converge toward the center of the outer peripheral iron core 20 at their radial inner end portions, each having an edge angle of approximately 120°. The radial inner end portions of the cores 41 to 43 are separated from each other by gaps 101 to 103, which can be magnetically coupled.

In other words, in the first embodiment, the radial inner end portion of the core 41 is separated from the radial inner end portions of the two adjacent cores 42 and 43 by the gaps 101 and 103, respectively. The same is true for the other cores 42 and 43. Note that, the gaps 101 to 103 ideally have the same dimensions, but may have different dimensions. In embodiments described later, a description regarding the gaps 101 to 103, the core coils 31 to 33, and the like may be omitted.

As described above, in the first embodiment, the core coils 31 to 33 are disposed inside the outer peripheral iron core 20. In other words, the core coils 31 to 33 are surrounded by the outer peripheral iron core 20. The outer peripheral iron core 20 can reduce leakage of magnetic flux generated by the coils 51 to 53 to the outside.

Figure 2A:
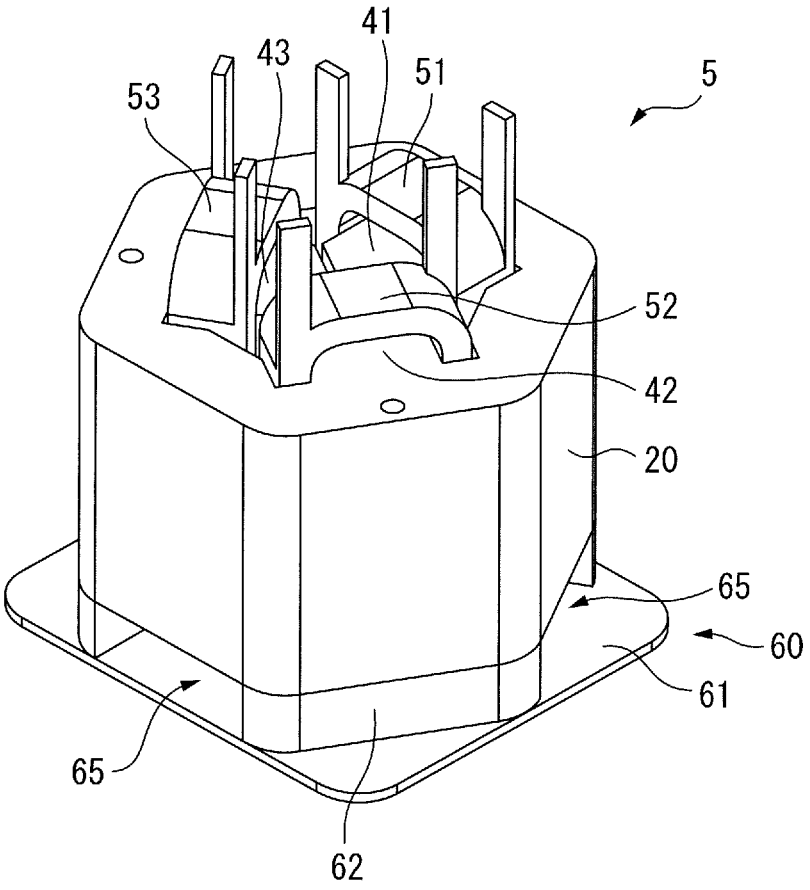
FIG. 2A is a perspective view of a reactor according to a second embodiment.
Figure 2B:
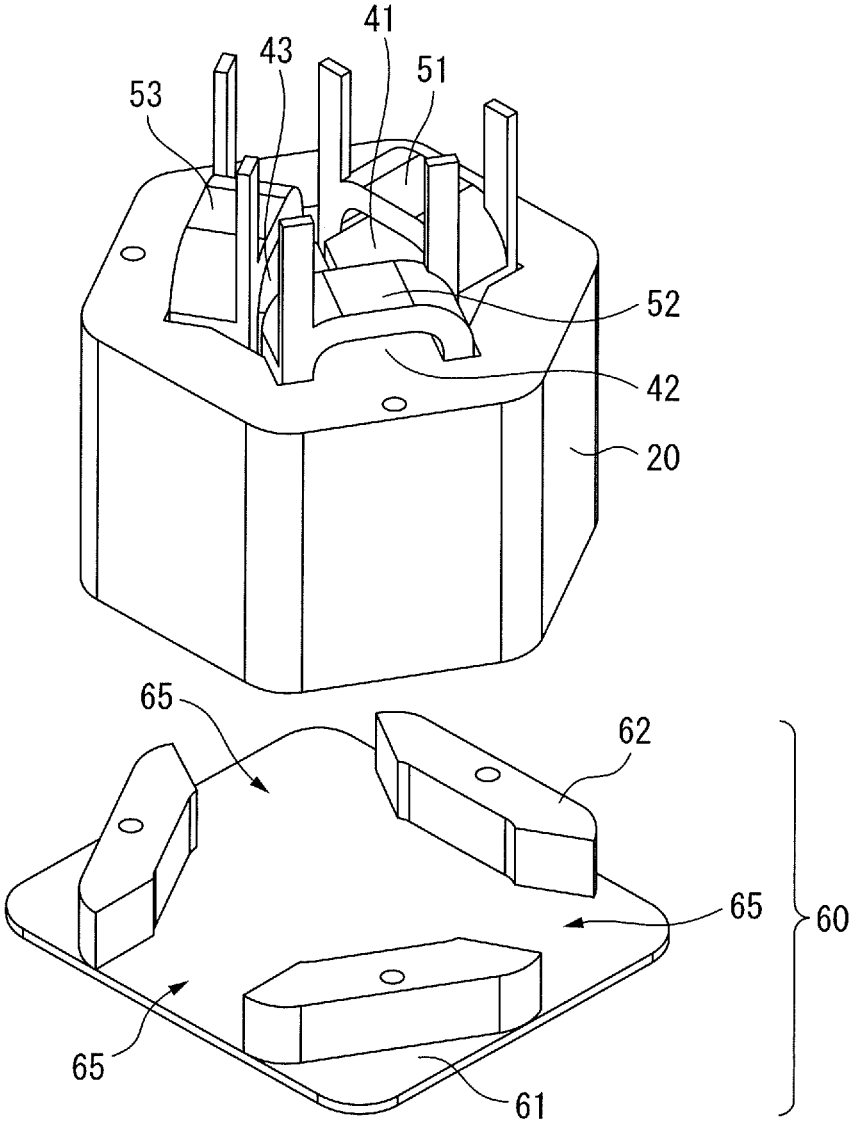
FIG. 2B is an exploded perspective view of the reactor shown in FIG. 2A.

FIG. 2A is a perspective view of a reactor according to a second embodiment. FIG. 2B is an exploded perspective view of the reactor shown in FIG. 2A. As shown in the drawings, an attachment unit 60 is attached to one end surface of an outer peripheral iron core 20 or the end surfaces of cores 41 to 43. The attachment unit 60 includes an end plate 61 and a cylindrical extension portion 62. The extension portion 62 is disposed with respect to the center of the end plate 61 so as to extend in the perpendicular direction of the end plate 61, and has an outer shape corresponding to the outer peripheral iron core 20. Since the end plate 61 is attached to an attachment surface of a non-illustrated other member, the attachment unit 60 serves to attach the outer peripheral iron core 20 or the cores 41 to 43 in a predetermined position or positions.

In a side wall of the extension portion 62 of the attachment unit 60, at least one, e.g., three ventilation ports, e.g., notches 65 are formed, as shown in FIGS. 2A and 2B. As shown in the drawings, when the outer peripheral iron core 20 has a hexagonal cross-section, the extension portion 62 having the notches 65 also forms a hexagonal cross-section. When the outer peripheral iron core 20 has a polygonal cross-section, the extension portion 62 is preferably removed at portions corresponding to a middle side of each of three adjacent sides in cross-section of the extension portion 62, to form the notches 65. This facilitates forming the notches 65.

When a plurality of notches 65 are formed, the notches 65 are preferably formed at equal intervals in the circumferential direction. This allows the outer peripheral iron core 20 to be stably attached to the extension portion 62.

The attachment unit 60 is attached to the end surface of the outer peripheral iron core 20 or the end surfaces of the cores 41 to 43 only on one side, while the peripheral surface and the other end surface of the outer peripheral iron core 20 are exposed. The at least one ventilation port, e.g., notches 65 are formed in the attachment unit 60. Thus, fluid, e.g., air passes through the internal space of the outer peripheral iron core 20 and the ventilation ports 65 of the attachment unit 60, and thereby dissipating heat from the coils 51 to 53, when the reactor 5 is driven. Therefore, the reactor 5 has improved heat dissipation. Consequently, heat dissipation of the reactor 5 can be improved. Since the notches 65 are merely formed in portions of the attachment unit 60 for securing the outer peripheral iron core 20, it is possible to eliminate the need to provide another component in the reactor 5. This prevents an increase in the size of the reactor 5, while allowing for a reduction in the weight of the reactor 5. Instead of the notches 65, through holes or slots may be formed in the extension portion 62 as ventilation ports. In this case, the same effects as described above can be obtained.

Figure 3:
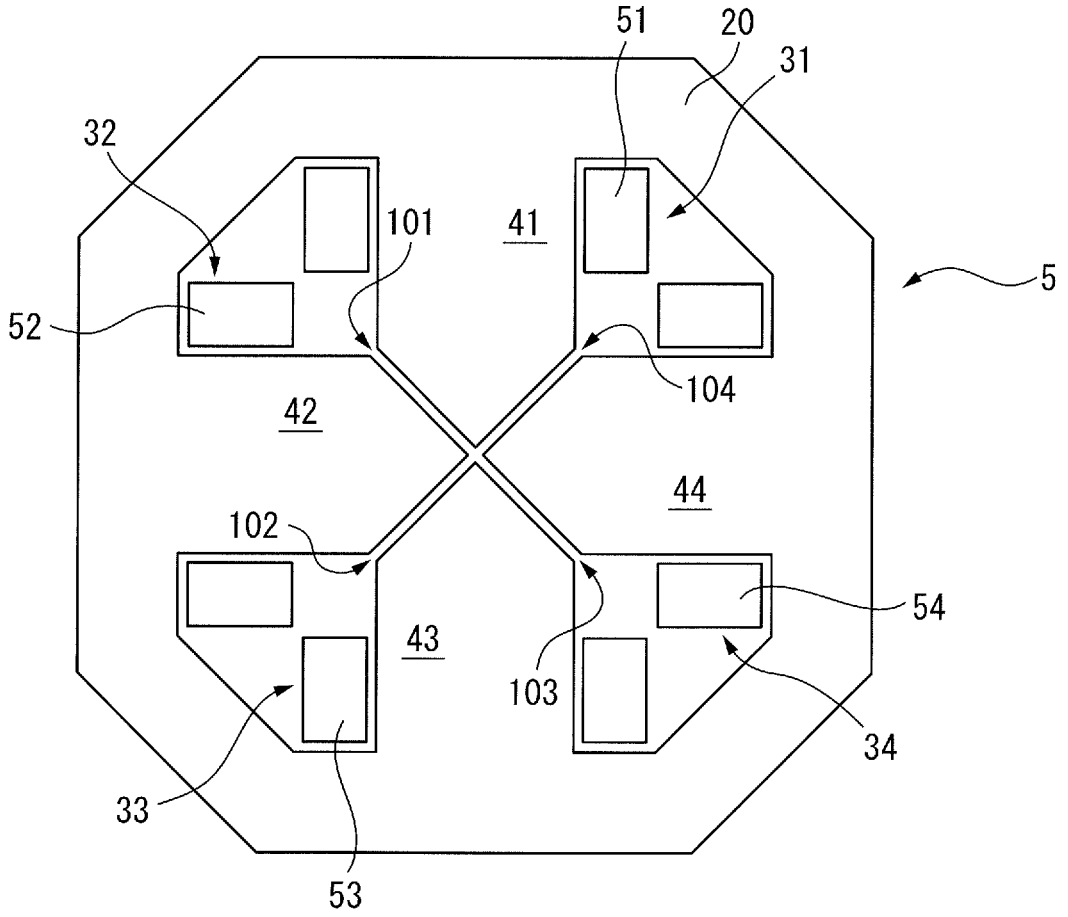
FIG. 3 is a cross-sectional view of a reactor according to a third embodiment.

FIG. 3 is a cross-sectional view of a reactor according to a third embodiment. In FIG. 3, a reactor 5 includes an approximately octagonal outer peripheral iron core 20 and four core coils 31 to 34 contacting or connected to an inner surface of the outer peripheral iron core 20, in the same manner as described above. The core coils 31 to 34 are arranged at approximately equal intervals in the circumferential direction of the reactor 5. The number of cores is preferably an even number greater than 4, and the reactor 5 can be thereby used as a single-phase reactor.

As is apparent from the drawing, the core coils 31 to 34 include cores 41 to 44 extending in the radial direction and coils 51 to 54 wound onto the cores 41 to 44, respectively. The cores 41 to 44 are in contact or integral with the outer peripheral iron core 20 at their radial outer end portions.

Furthermore, the radial inner end portions of the cores 41 to 44 are disposed in the vicinity of the center of the outer peripheral iron core 20. In FIG. 3, the cores 41 to 44 converge toward the center of the outer peripheral iron core 20 at their radial inner end portions, each having an edge angle of approximately 90°. The radial inner end portions of the cores 41 to 44 are separated from each other by gaps 101 to 104, which can be magnetically coupled.

Figure 4:
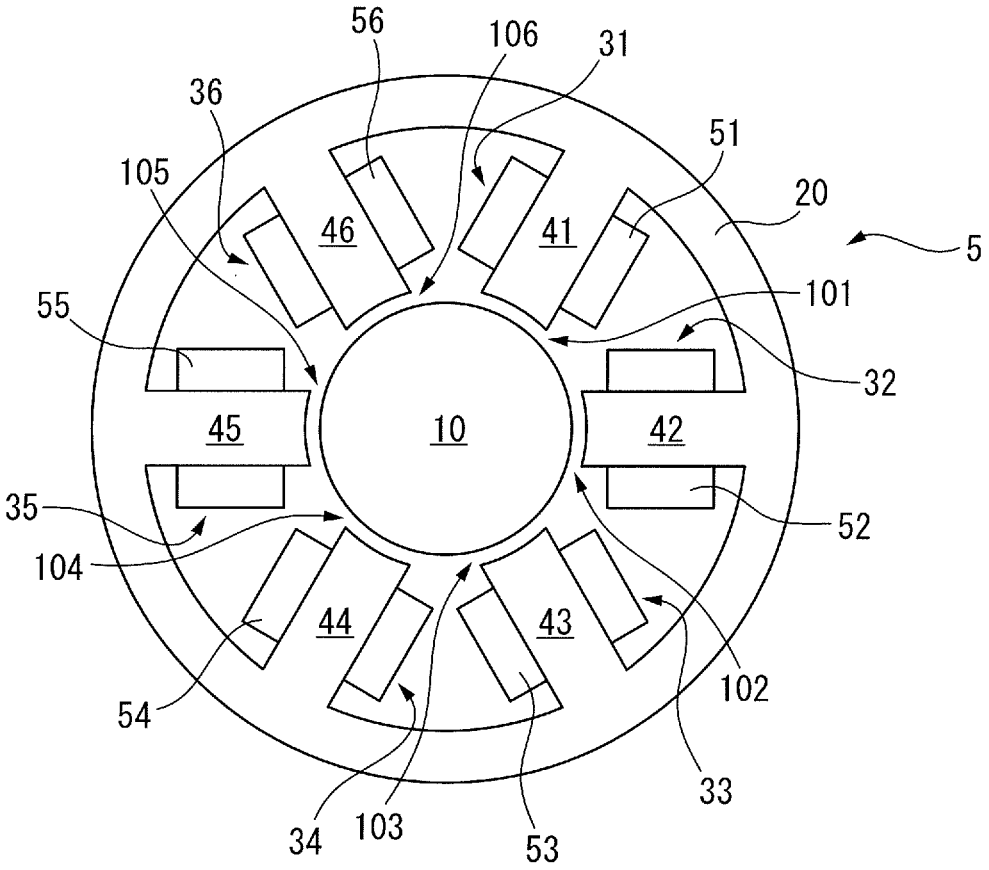
FIG. 4 is a cross-sectional view of a reactor according to a fourth embodiment.

Furthermore, FIG. 4 is a cross-sectional view of a reactor according to a fourth embodiment. In FIG. 4, a reactor 5 includes a round outer peripheral iron core 20 and six core coils 31 to 36. The core coils 31 to 36 include cores 41 to 46 and coils 51 to 56 wound onto the cores 41 to 46, respectively. The cores 41 to 46 are in contact or integral with an inner surface of the outer peripheral iron core 20. A central core 10 is disposed at the center of the outer peripheral iron core 20. The central core 10 is formed in the same manner as the outer peripheral iron core 20. Each of gaps 101 to 106, through which magnetic connection can be established, is formed between each of radial inner end portions of the cores 41 to 46 and the central core 10.

The above-described attachment unit 60 is attached to an end surface of the outer peripheral iron core 20 on one side, end surfaces of the cores 41 to 46 on one side, or an end surface of the central core 10 on one side as shown in FIG. 3 or 4. Such reactors 5 have improved heat dissipation, for the same reason as described above.

The reactor 5 having the structure shown in FIG. 1 will be described below in more detail. The following description is generally applicable to the reactors 5 shown in FIGS. 3 and 4 as well.

Figure 5A:
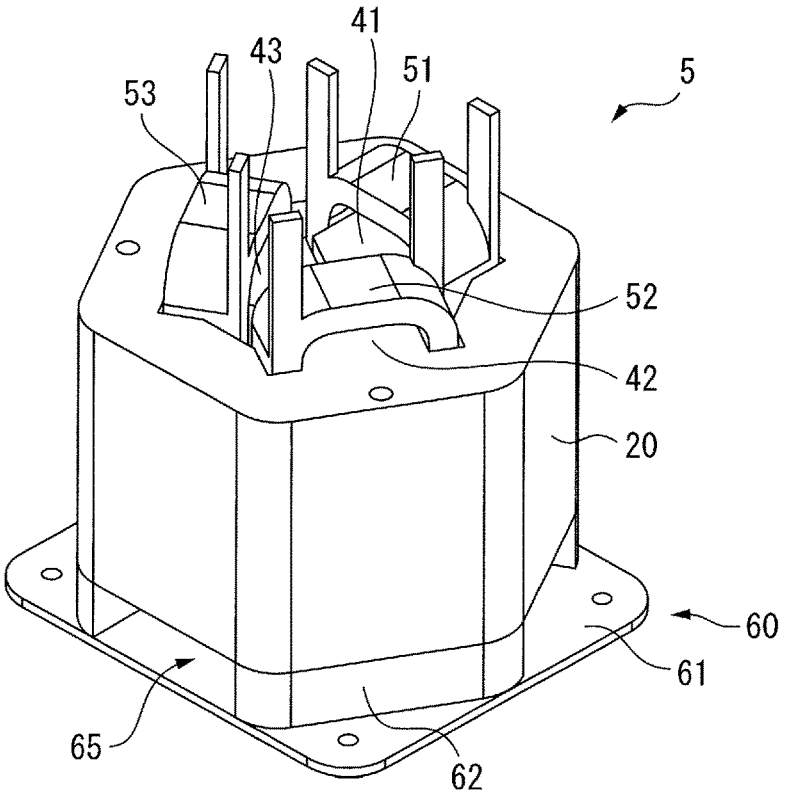
FIG. 5A is a perspective view of a reactor according to a fifth embodiment.
Figure 5B:
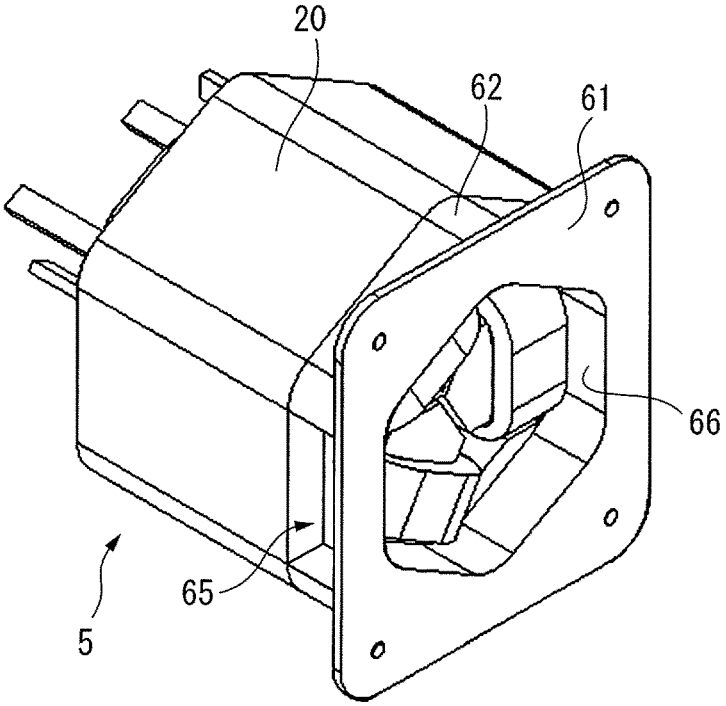
FIG. 5B is another perspective view of the reactor shown in FIG. 5A.

FIG. 5A is a perspective view of a reactor according to a fifth embodiment. FIG. 5B is another perspective view of the reactor shown in FIG. 5A. As shown in the drawing, a through hole 66 is formed in the middle of an end plate 61. The through hole 66 is formed in a position approximately corresponding to an inner peripheral surface of an outer peripheral iron core 20, and in approximately the same shape as the inner peripheral surface of the outer peripheral iron core 20. In this case, since heat dissipates through the through hole 66, the reactor 5 has improved heat dissipation. Furthermore, the through hole 66 serves to reduce the weight of the reactor 5. A plurality of through holes may be formed in an area of the end plate 61 corresponding to the outer peripheral iron core 20. Furthermore, a plurality of through holes may be formed between the outer peripheral iron core 20 and each of cores 41 to 43. A through hole may be formed in a portion of the end plate 61 corresponding to the axial direction of the outer peripheral iron core 20 or the cores 41 to 43. Forming the through holes in such positions has reduced effects on magnetic flux. Thus, holes may be formed in such positions of the outer peripheral iron core 20 or the cores 41 to 43, as described later.

Figure 6A:
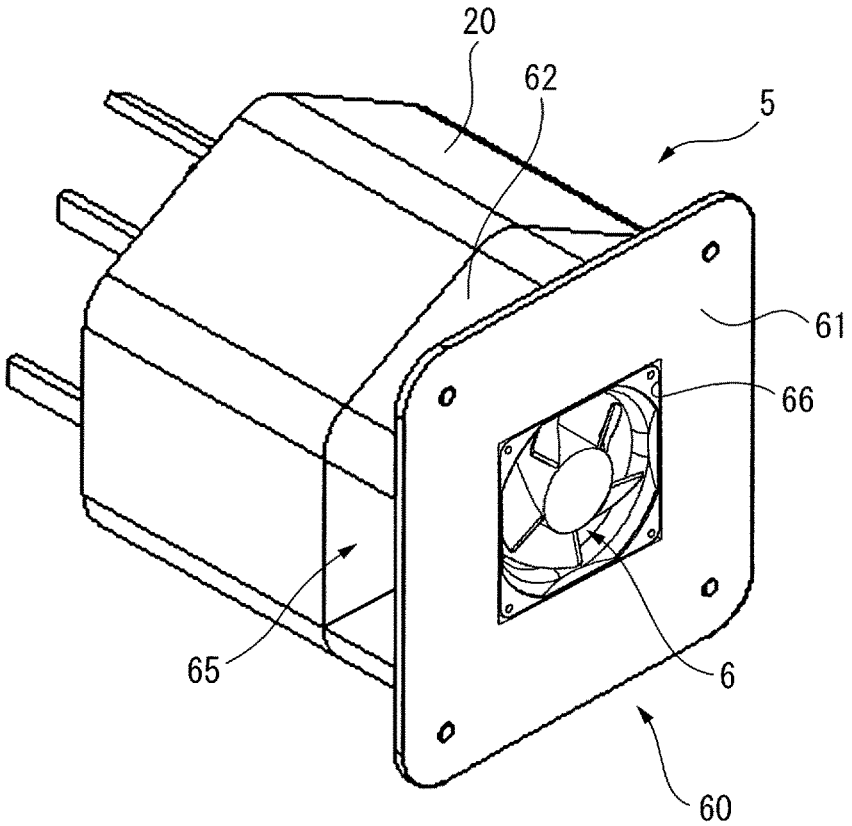
FIG. 6A is a perspective view of a reactor according to a sixth embodiment.
Figure 6B:
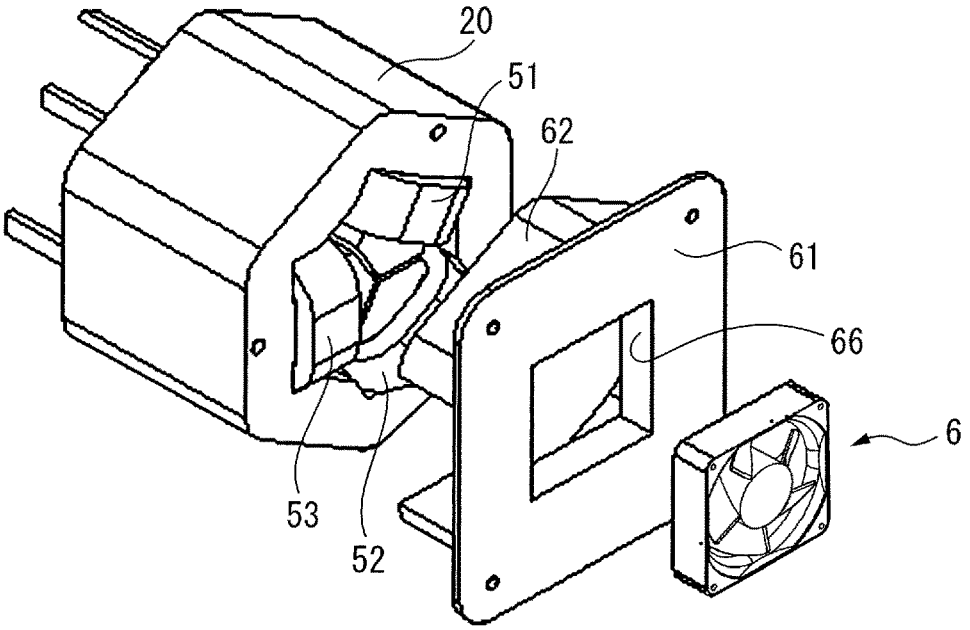
FIG. 6B is an exploded perspective view of the reactor shown in FIG. 6A.

FIG. 6A is a perspective view of a reactor according to a sixth embodiment. FIG. 6B is an exploded perspective view of the reactor shown in FIG. 6A. In the drawings, a square through hole 66 is formed in an end plate 61 of an attachment unit 60. A cooling fan 6 having a shape corresponding to the through hole 66 is attached to the through hole 66. The cooling fan 6 is driven by a non-illustrated motor.

Figure 6C:
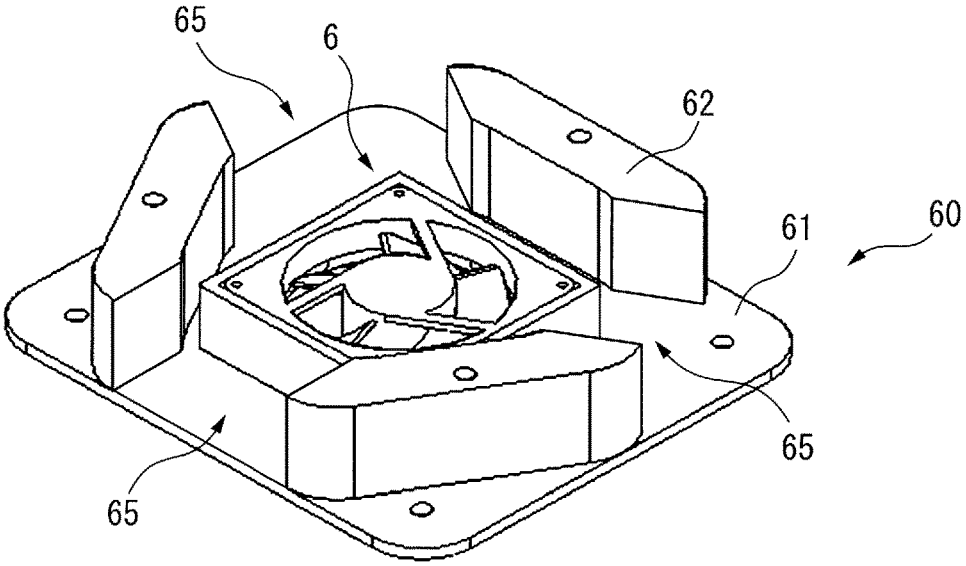
FIG. 6C is a perspective view of an attachment unit shown in FIG. 6B.
Figure 6D:
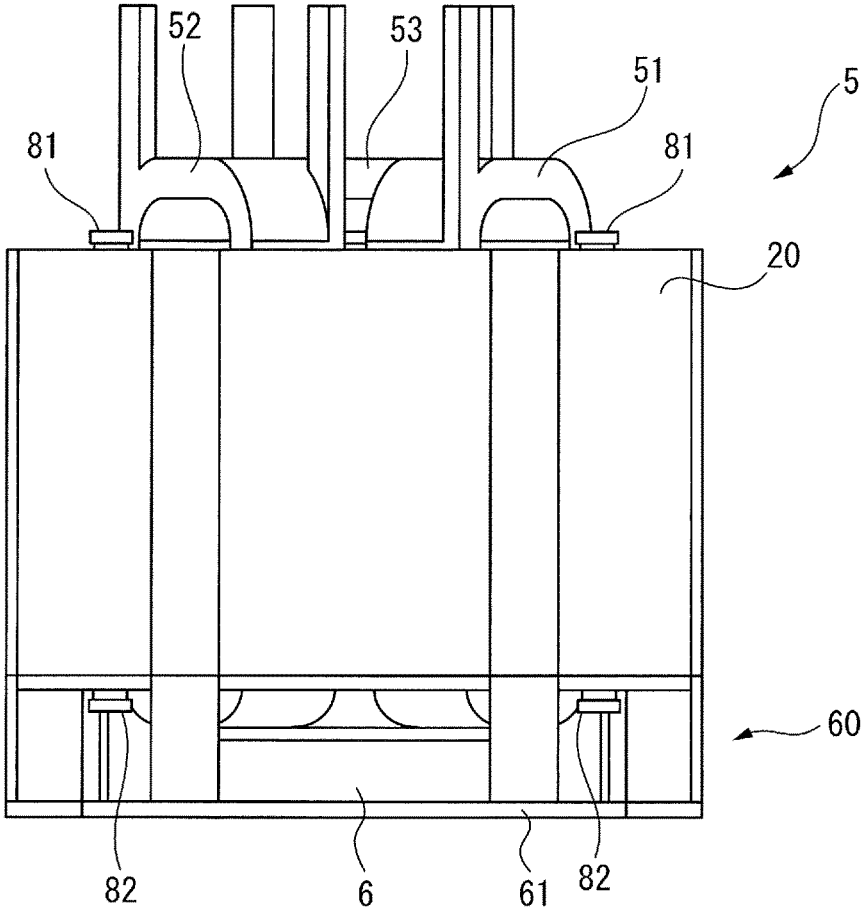
FIG. 6D is a side view of the reactor shown in FIG. 6A.

As can be understood from FIG. 6A, the bottom of the cooling fan 6 is preferably flush with the bottom surface of the end plate 61. As shown in FIG. 6C, which is a perspective view of the attachment unit shown in FIG. 6B, the top of the cooling fan 6 attached to the end plate 61 is lower than the top surface of an extension portion 62. FIG. 6D is a side view of the reactor shown in FIG. 6A. As shown in FIG. 6D, an outer peripheral iron core 20, which has coils 51 to 53 wound onto cores 41 to 43, is attached to the attachment unit 60 with screws 81 and 82, as described later. Therefore, the cooling fan 6 is positioned under the coils 51 to 53.

When the cooling fan 6 is driven, a current of air blows directly from the cooling fan 6 onto the coils 51 to 53, and flows through gaps 101 to 103 in the axial direction of the outer peripheral iron core 20. This improves the heat dissipation of the reactor 5. In this case, since the air directly blows from the cooling fan 6 onto the coils 51 to 53, the cooling effect is further improved.

Figure 7A:
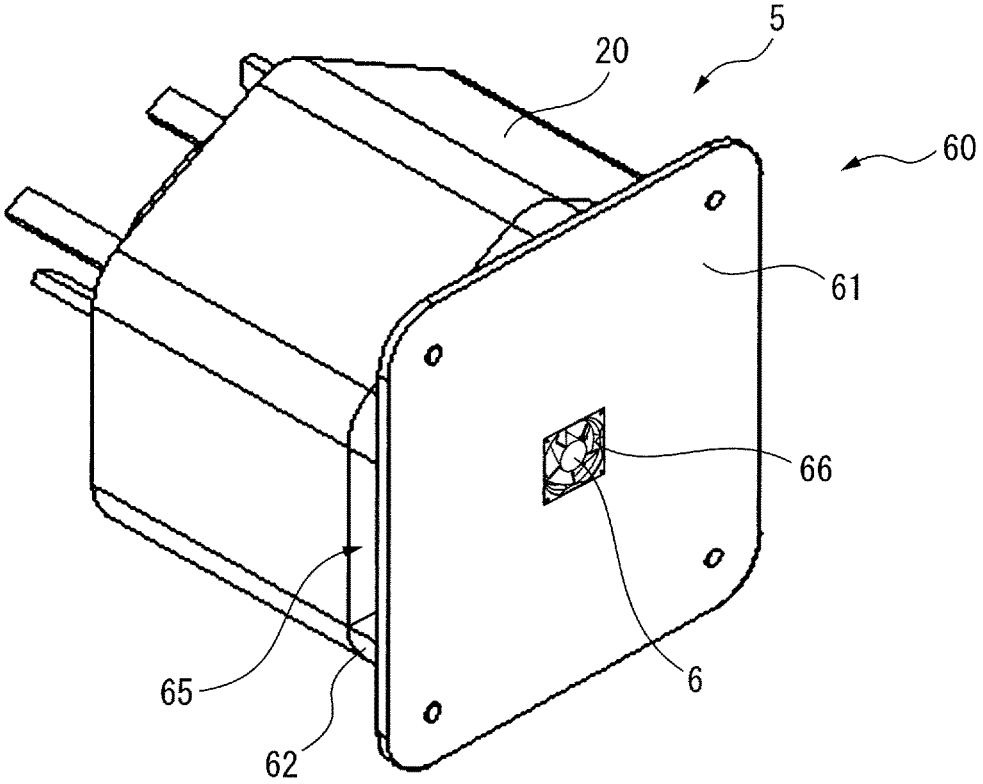
FIG. 7A is a perspective view of a reactor according to a seventh embodiment.
Figure 7B:
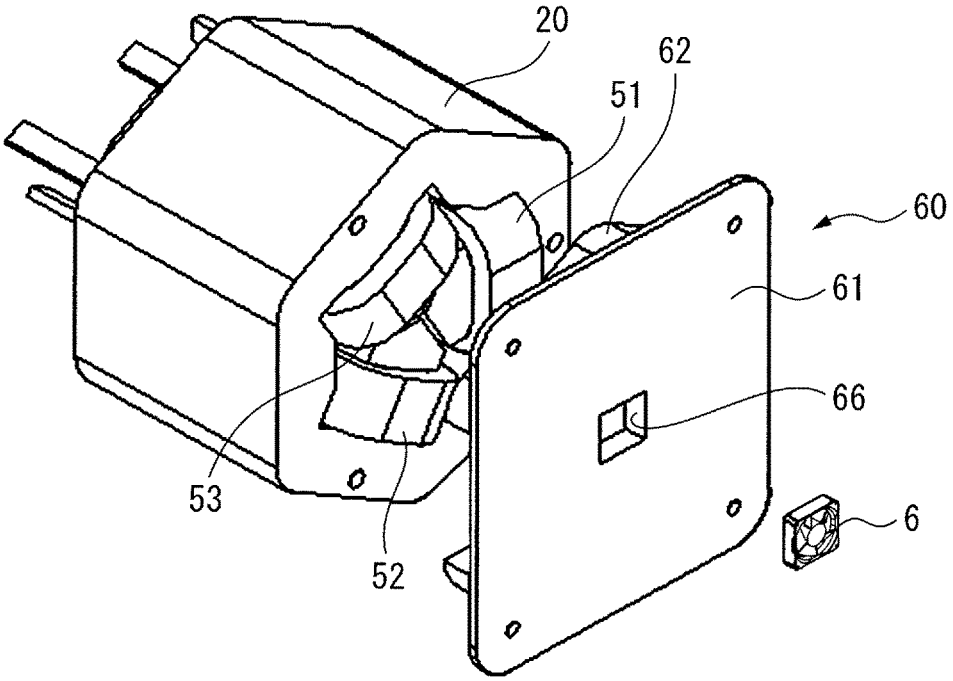
FIG. 7B is an exploded perspective view of the reactor shown in FIG. 7A.

FIG. 7A is a perspective view of a reactor according to a seventh embodiment. FIG. 7B is an exploded perspective view of the reactor shown in FIG. 7A. In the drawings, a square through hole 66 that is smaller than the above-described through hole is formed in an end plate 61 of an attachment unit 60. A cooling fan 6 having a shape corresponding to the through hole 66 is attached to the through hole 66. The cooling fan 6 is driven by a non-illustrated motor.

Figure 7C:
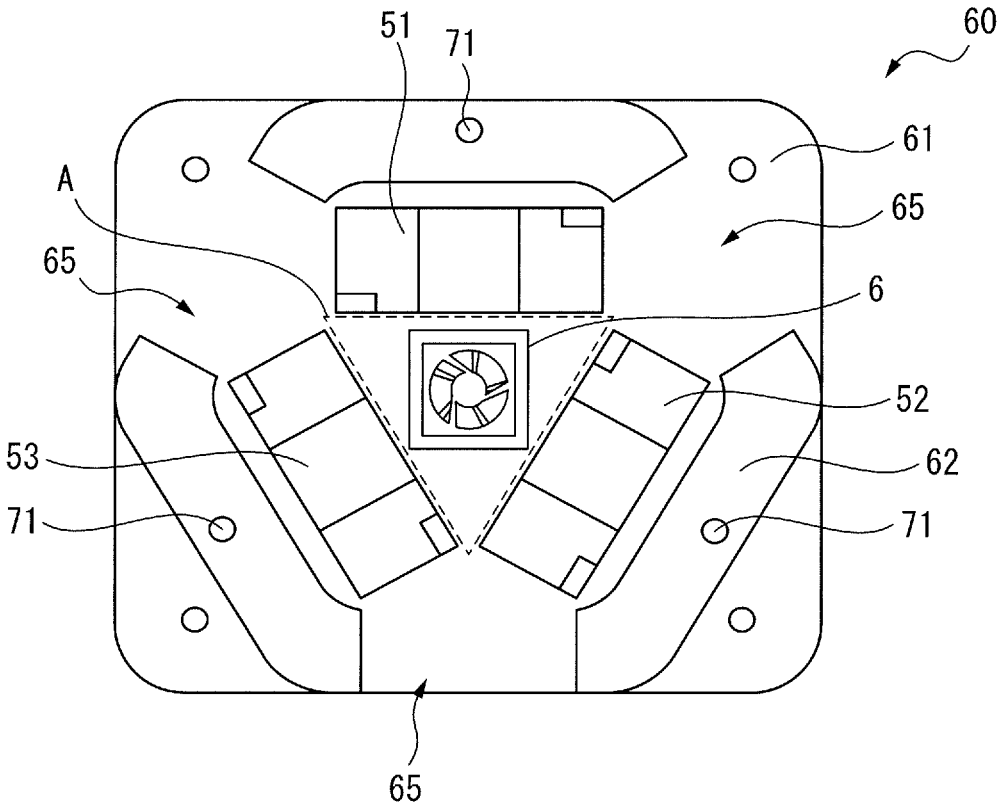
FIG. 7C is a top view of an attachment unit shown in FIG. 7A.

FIG. 7C is a top view of the attachment unit shown in FIG. 7A. For ease of understanding, coils 51 to 53 in a state of attaching the attachment unit 60 to the outer peripheral iron core 20 are illustrated in FIG. 7C. A triangular area A is formed on radial inner sides of the coils 51 to 53. As a matter of course, the shape of the area A differs depending on the number of coils, and the area A generally has a polygonal shape having the same number of sides as the number of coils. The cooling fan 6 and the through hole 66 are disposed in the area A.

Figure 7D:
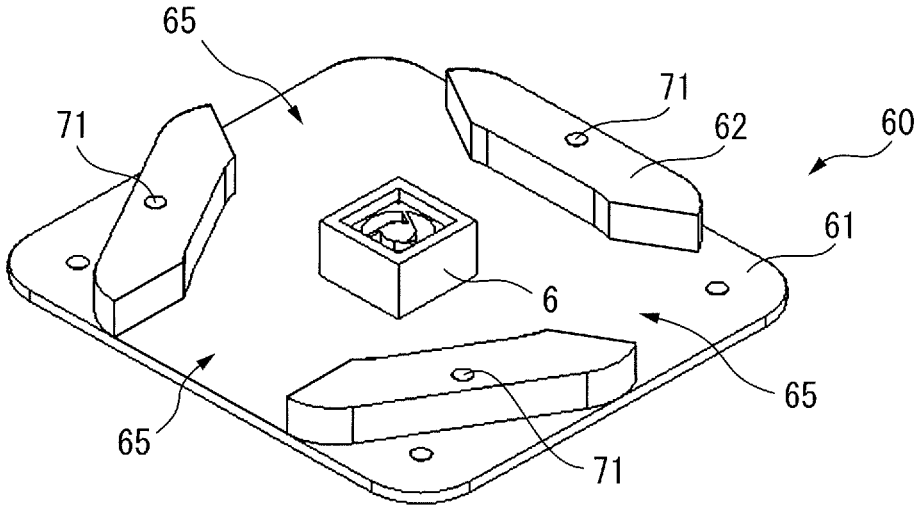
FIG. 7D is a perspective view of the attachment unit shown in FIG. 7B.
Figure 7E:
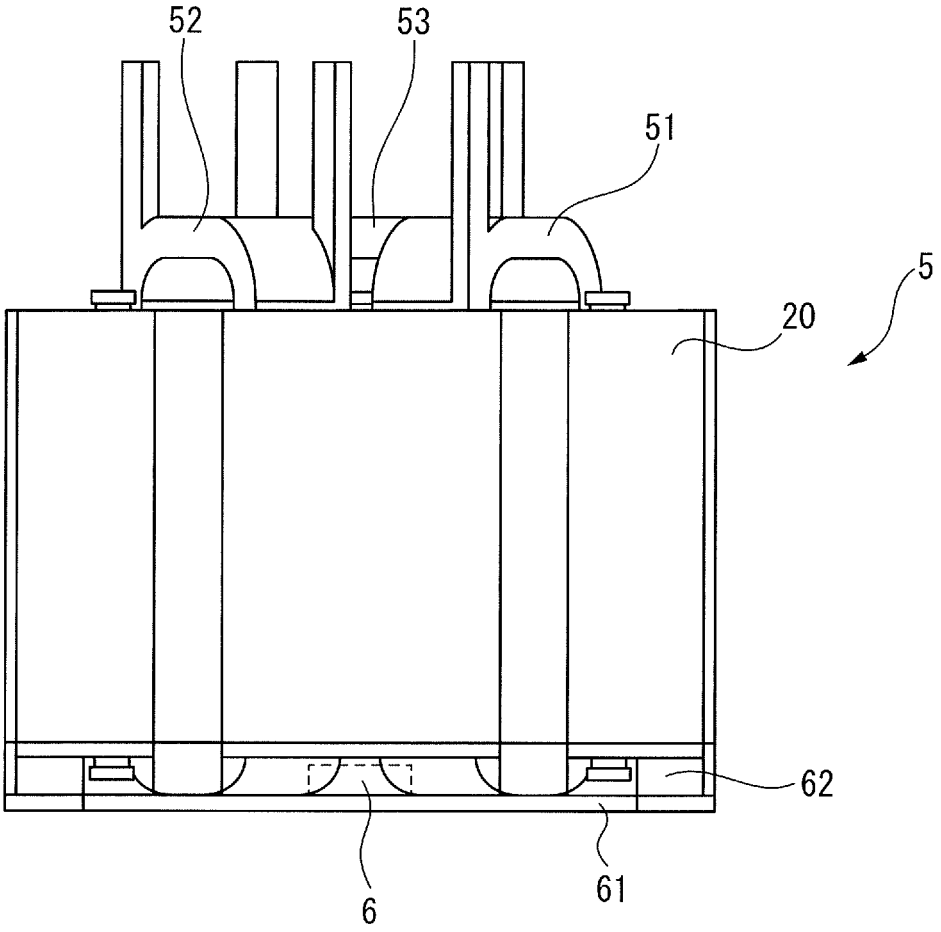
FIG. 7E is a side view of the reactor shown in FIG. 7A.

FIG. 7D is a perspective view of the attachment unit shown in FIG. 7B. When the cooling fan 6 is attached to the end plate 61 in the same manner as described above, the top of the cooling fan 6 is approximately flush with a top surface of an extension portion 62. FIG. 7E is a side view of the reactor shown in FIG. 7A. As shown in FIG. 7E, the outer peripheral iron core 20, which has the coils 51 to 53 wound onto cores 41 to 43, is attached to the attachment unit 60. Thus, the bottoms of the coils 51 to 53 are positioned in the vicinity of the end plate 61, and the top of the cooling fan 6 is positioned higher than the bottoms of the coils 51 to 53.

When the cooling fan 6 is driven, a current of air flows from the cooling fan 6 through gaps 101 to 103 in the axial direction of the outer peripheral iron core 20. In this case, since the cooling fan 6 is disposed in such a position as not to interfere with the coils 51 to 53, the height of the extension portion 62 can be lowered. As a result, it is possible to prevent an increase in the size of the whole reactor 5.

Figure 8A:
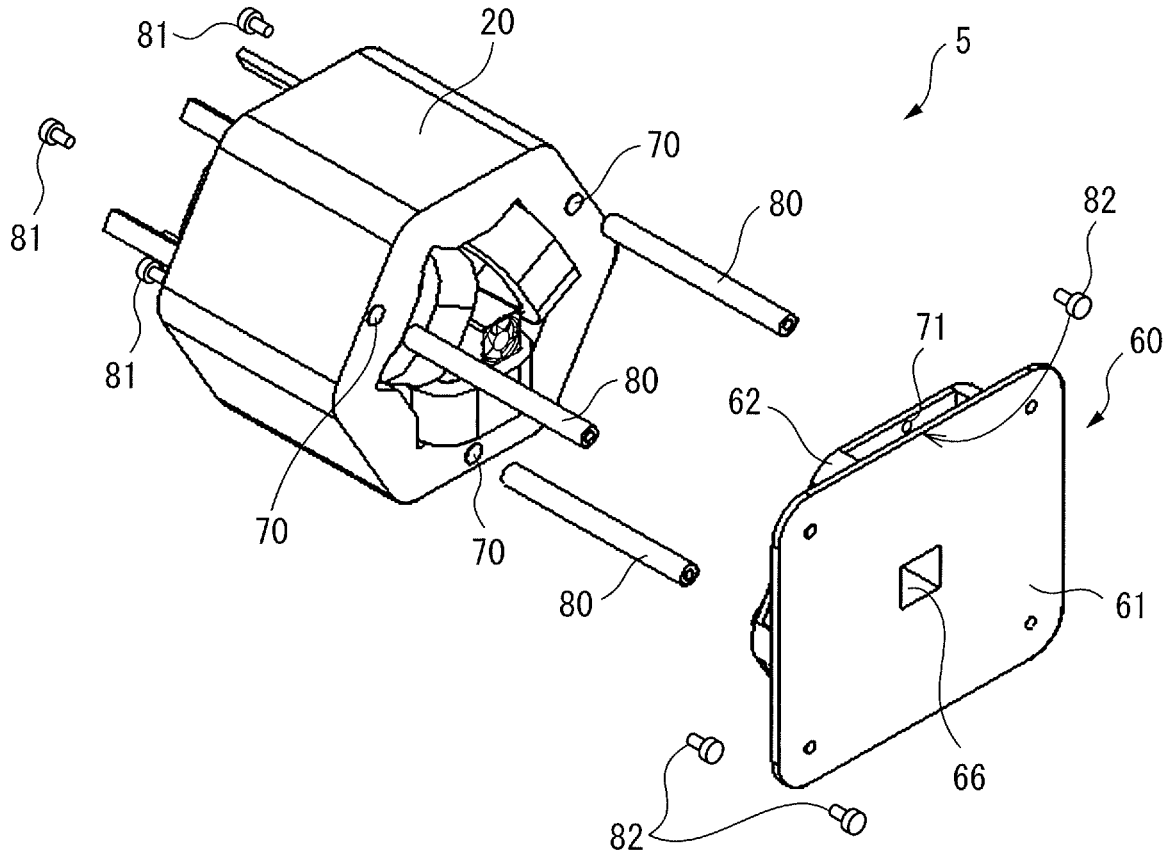
FIG. 8A is an exploded perspective view of a reactor according to an eighth embodiment.

FIG. 8A is an exploded perspective view of a reactor according to an eighth embodiment. As shown in FIG. 8A, at least one hole 70 extending in the axial direction is formed in an outer peripheral iron core 20 at equal intervals in the circumferential direction. A hollow rod 80 having a screw thread formed in an inner peripheral surface thereof is inserted into the hole 70. The rod 80 has approximately the same length as the outer peripheral iron core 20 in the axial direction. The rod 80 serves as a connection rod for connecting between an attachment unit 60 and the outer peripheral iron core 20. The hole 70 is formed in such a portion of the outer peripheral iron core 20 so as to have little effect on magnetic flux. In the same manner, a hole 70 may be formed in such a portion of cores 41 to 46 so as to have little effect on magnetic flux.

As is apparent from FIGS. 7C and 7D, in particular, holes 71 are formed in an extension portion 62 of the attachment unit 60. The ends of the rods 80 are disposed on the holes 71 of the extension portion 62, and screws 82 are screwed into the rods 80. In the same manner, screws 81 are screwed into the other ends of the rods 80 on an end surface of the outer peripheral iron core 20 on the far side from the attachment unit 60. Therefore, the attachment unit 60 and the outer peripheral iron core 20 can be connected without an increase in size.

Figure 8B:
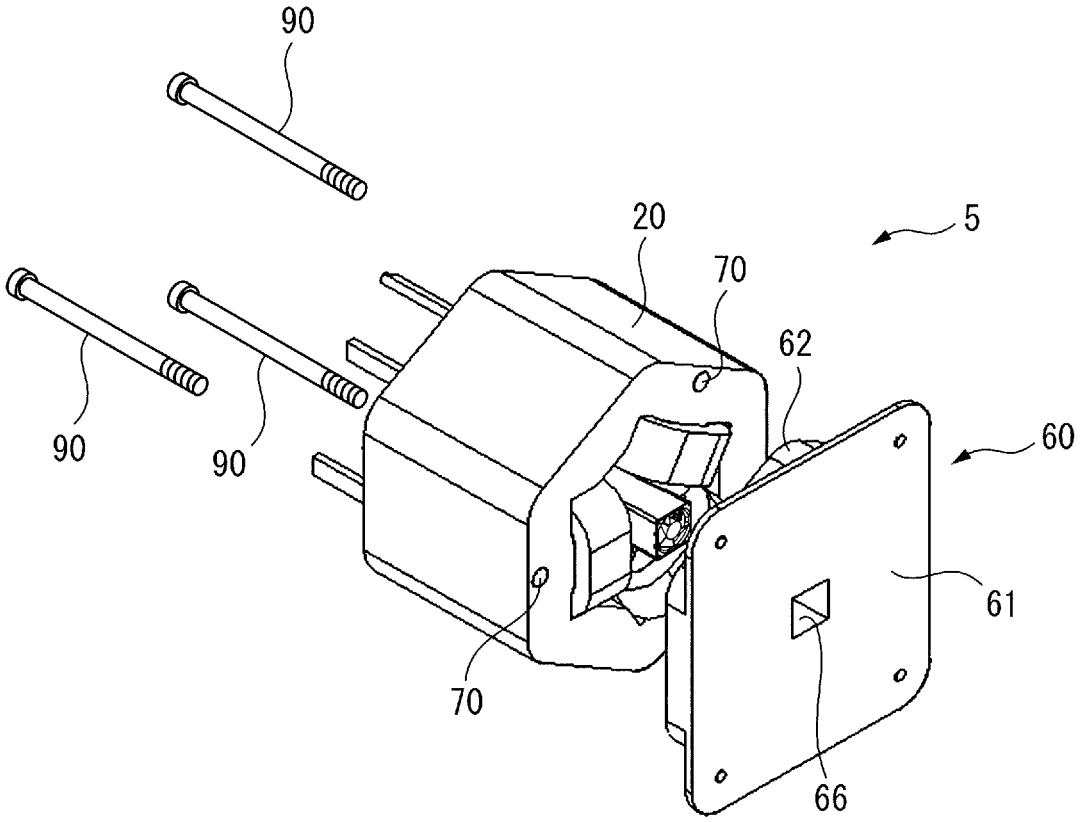
FIG. 8B is an exploded perspective view of another reactor according to the eighth embodiment.

FIG. 8B is an exploded perspective view of another reactor according to the eighth embodiment. In FIG. 8B, long screws 90, which function as connection rods, penetrate through holes 70 of an outer peripheral iron core 20, and tip ends of the long screws 90 are screwed into holes 71 of an extension portion 62. For this purpose, threading is cut in inner surfaces of the holes 71. In this case, the same effects as described above can be obtained, while the number of components can be lower than in FIG. 8A.

Figure 9A:
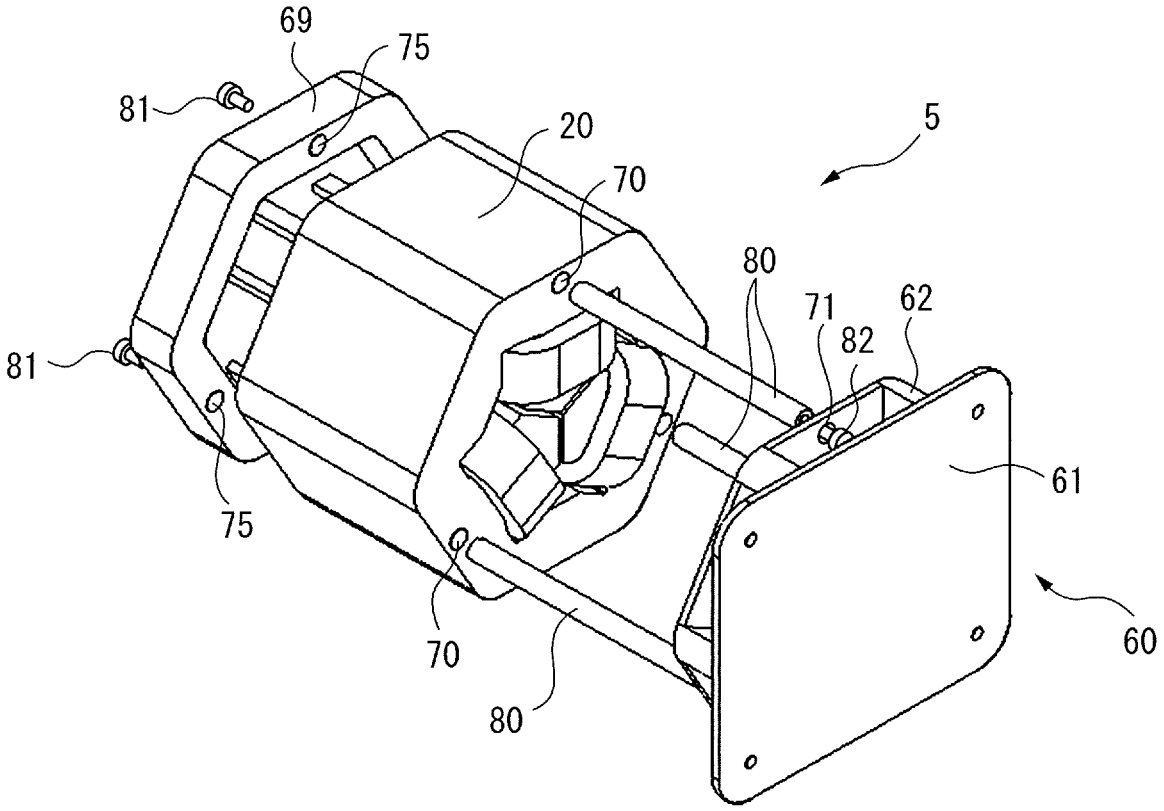
FIG. 9A is an exploded perspective view of a reactor according to a ninth embodiment.

FIG. 9A is an exploded perspective view of a reactor according to a ninth embodiment. In FIG. 9A, a ring member 69 is disposed on an end surface of an outer peripheral iron core 20 on the opposite side to an attachment unit 60. The ring member 69 is preferably formed in the same manner as the outer peripheral iron core 20. The axial length of the ring member 69 is preferably longer than the protrusion length of coils 51 to 53 protruding from the end surface of the outer peripheral iron core 20. Through holes 75 are formed in the ring member 69 in positions corresponding to holes 70 of the outer peripheral iron core 20. The length of each rod 80 shown in FIG. 9A approximately corresponds to the sum of the axial length of the outer peripheral iron core 20 and the axial length of the ring member 69.

In the same manner as described above, the ends of the rods 80 inserted into the holes 70 of the outer peripheral iron core 20 are disposed on holes 71 of an extension portion 62, and screws 82 are screwed into the rods 80. In the same manner, screws 81 are screwed into the other ends of the rods 80 penetrating through the through holes 75 of the ring member 69. Therefore, the attachment unit 60, the outer peripheral iron core 20, and the ring member 69 can be connected without an increase in size.

Figure 9B:
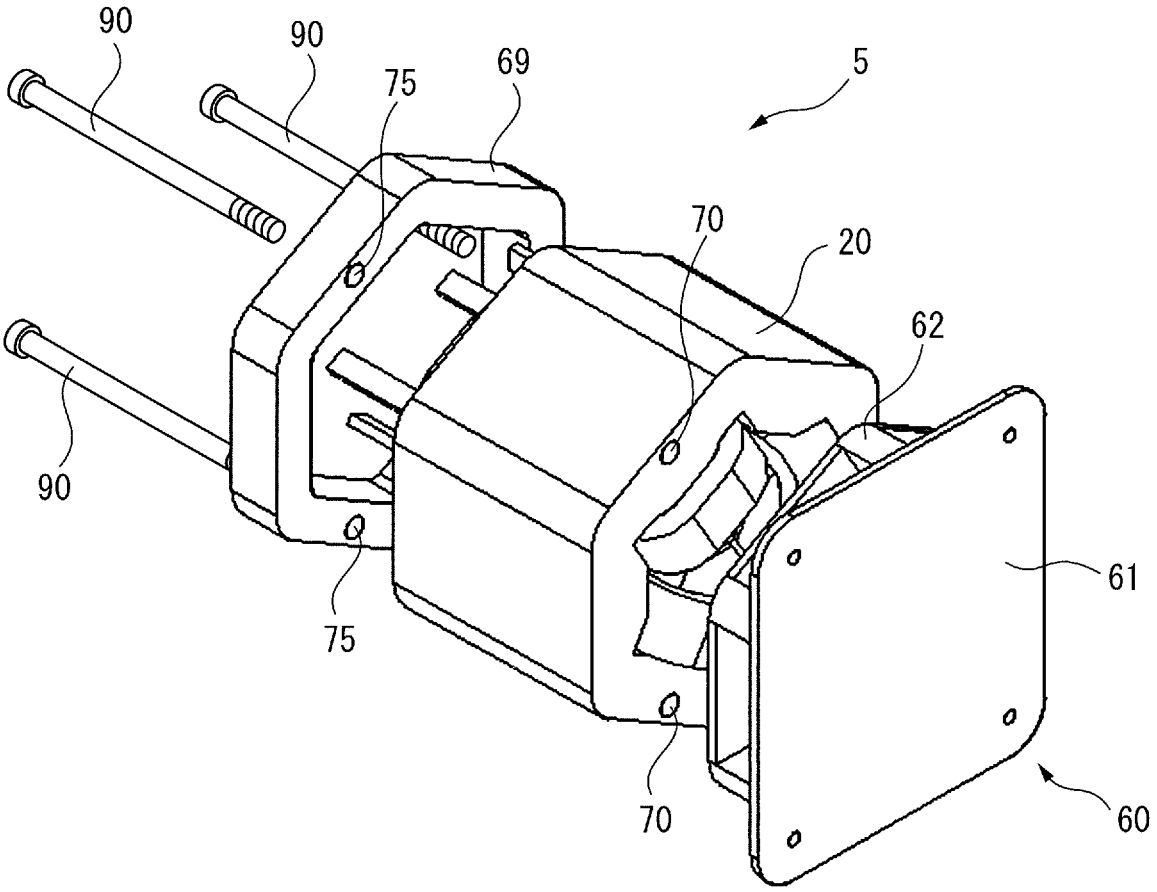
FIG. 9B is an exploded perspective view of another reactor according to the ninth embodiment.

FIG. 9B is an exploded perspective view of another reactor according to the ninth embodiment. In FIG. 9B, long screws 90 penetrate through holes 75 of a ring member 69 and holes 70 of an outer peripheral iron core 20, and tip ends of the long screws 90 are screwed into holes 71 of an extension portion 62. In this case, the same effects as described above can be obtained.

Figure 10:
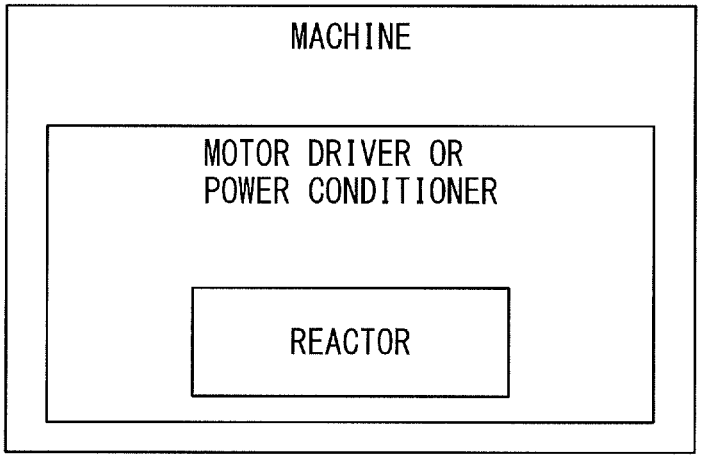
FIG. 10 is a block diagram of a machine including a reactor.

FIG. 10 is a block diagram of a machine including a reactor. In FIG. 10, a reactor 5 is used in a motor driver or a power conditioner. The machine includes the motor driver or the power conditioner. In this case, the motor driver, power conditioner, machine, and the like having the reactor 5 can be easily provided. The scope of the present invention includes appropriate combinations of some of the above-described embodiments.

Aspects of Disclosure

A first aspect provides a reactor (5) that includes an outer peripheral iron core (20), and at least three core coils (31-36) contacting or connected to an inner surface of the outer peripheral iron core. Each of the core coils includes a core (41-46) and a coil (51-56) wound onto the core. The reactor further includes an attachment unit (60) disposed on one end surface of the outer peripheral iron core, for attaching the outer peripheral iron core in a predetermined position, and at least one ventilation port (65) formed in the attachment unit.

According to a second aspect, the first aspect further includes a central core (10) disposed at the center of the outer peripheral iron core.

According to a third aspect, in the first or second aspect, the attachment unit includes an end plate and an extension portion extending in a perpendicular direction of the end plate, and a through hole (66) is formed in a portion of the end plate corresponding to an axial direction of the outer peripheral iron core or the cores.

According to a fourth aspect, the third aspect further includes a cooling fan (6) attached to the through hole.

According to a fifth aspect, in the fourth aspect, the cooling fan is disposed on radial inner sides of the coils of the at least three core coils.

According to a sixth aspect, in any one of the first to fifth aspect, the outer peripheral iron core has a hole (70) extending in an axial direction, and the attachment unit and the outer peripheral iron core are connected with a connection rod (80, 90) inserted into the hole.

Advantageous Effects of the Aspects

According to the first aspect, the attachment unit is attached to only one end surface of the outer peripheral iron core, and the at least one ventilation port is formed in the attachment unit. Thus, since fluid, e.g., air flowing through the internal space of the outer peripheral iron core and the ventilation port of the attachment unit serves to dissipate heat, the reactor has improved heat dissipation. Furthermore, it is possible to eliminate the need to provide an additional member for heat dissipation in an installed state, thus preventing an increase in the size of the reactor while allowing a reduction in the weight of the reactor. Furthermore, since a reactor case is not required, the reactor can be manufactured at a reduced cost.

According to the second aspect, even if the reactor has a central core, the reactor has improved heat dissipation.

According to the third aspect, since heat dissipates through the through hole formed in the portion of the end plate, the reactor has improved heat dissipation. Furthermore, the reactor has a reduced weight.

According to the fourth aspect, the cooling fan improves the heat dissipation of the reactor.

According to the fifth aspect, since the cooling fan does not interfere with the coils, the height of the extension portion can be lowered.

According to the sixth aspect, the attachment unit and the outer peripheral iron core can be connected without an increase in size.

The present invention is described above with reference to the preferred embodiments, but it is apparent for those skilled in the art that the above modifications and other various modifications, omissions, and additions can be performed without departing from the scope of the present invention.

What is claimed is:

1. A reactor comprising:

an outer peripheral iron core;

at least three core coils contacting or connected to an inner surface of the outer peripheral iron core;

each of the core coils including a core and a coil wound onto the core; and an attachment unit disposed on one end surface of the outer peripheral iron core, for attaching the outer peripheral iron core in a predetermined position, the attachment unit including an end plate and a plurality of extension portions cantilevered to the end plate, each of the plurality of extension portions having a respective base abutting the end plate, the plurality of extension portions each extending in a perpendicular direction from the base to a respective distal end, each respective distal end of the plurality of extension portions abutting the end surface of the outer peripheral iron core at separate respective locations, the plurality of extension portions spaced apart from each other on the end plate to form ventilation ports between the end surface of the outer peripheral iron core and the end plate, wherein the outer peripheral iron core has a plurality of holes extending in an axial direction, and each of the plurality of extension portions has a respective hole extending in the axial direction from each respective distal end of the plurality of extension portions, and wherein the holes of the outer peripheral iron core and the holes of the extension portions are aligned, such that the attachment unit and the outer peripheral iron core are connected with screws extending through the holes of the outer peripheral iron core and the holes of the extension portions.

2. The reactor according to claim 1, further comprising a central core disposed at the center of the outer peripheral iron core.

3. The reactor according to claim 1, wherein the attachment unit includes an end plate and an extension portion extending in a perpendicular direction of the end plate, and a through hole is formed in a portion of the end plate corresponding to an axial direction of the outer peripheral iron core or the cores.

4. The reactor according to claim 3, further comprising a cooling fan attached to the through hole.

5. The reactor according to claim 4, wherein the cooling fan is disposed on radial inner sides of the coils of the at least three core coils.

6. The reactor according to claim 1, wherein the outer peripheral iron core has a hole extending in an axial direction, and the attachment unit and the outer peripheral iron core are connected with a connection rod inserted into the hole.

* * * * *